US006613216B2

(12) United States Patent
Bushman et al.

(10) Patent No.: US 6,613,216 B2
(45) Date of Patent: Sep. 2, 2003

(54) COMBINATION GALVANIC ANODE AND WEAR PLATE FOR STORAGE TANKS

(76) Inventors: James B. Bushman, 6395 Kennard Rd., Medina, OH (US) 44256; Brian C. Donovan, 4140 Three Lakes Dr., Long Grove, IL (US) 60047

( * ) Notice: Subject to any disclaimer, the term of this patent is extended or adjusted under 35 U.S.C. 154(b) by 0 days.

(21) Appl. No.: 09/858,063

(22) Filed: May 15, 2001

(65) Prior Publication Data

US 2002/0008112 A1 Jan. 24, 2002

Related U.S. Application Data

(60) Provisional application No. 60/218,955, filed on Jul. 17, 2000, and provisional application No. 60/204,247, filed on May 15, 2000.

(51) Int. Cl.[7] ..... C23F 13/00

(52) U.S. Cl. ..... 205/740; 205/730; 204/196.37; 204/196.23; 204/196.24; 204/196.25; 204/196.1

(58) Field of Search ..... 204/196.1, 196.23, 204/196.24, 196.25, 196.37; 205/730, 731, 732, 733, 740

(56) References Cited

U.S. PATENT DOCUMENTS 4,190,512 A * 2/1980 Wyatt et al. ..... 204/196.1
5,293,681 A * 3/1994 Tuma ..... 29/700

* cited by examiner

*Primary Examiner*—Bruce F. Bell
(74) *Attorney, Agent, or Firm*—Fay, Sharpe, Fagan, Minnich & McKee, LLP

(57) ABSTRACT

A storage tank for fluids comprises a novel striker plate. The striker plate is comprised of a sacrificial galvanic anode and a steel core, and it is situated opposite an access opening used for measuring depth of fluid in the tank. The striker plate can also function adjacent other corrosive areas in a tank, such as along a seam in a tank wall, to reduce corrosion.

12 Claims, 2 Drawing Sheets

COMBINATION GALVANIC ANODE AND WEAR PLATE FOR STORAGE TANKS

This application claims priority from U.S. Provisional Application Ser. No. 60/204,247 filed May 15, 2000 and Ser. No. 60/218,955 filed Jul. 17, 2000.

BACKGROUND

Fuel and other types of liquid storage tanks are typically tested for product depth by placement of a calibrated length dip stick into the tank through one of the access ports defined in a tank wall. The contacting of the tank bottom during this product depth measurement process initiates and accelerates corrosion activity in the bottom of the storage tanks, particularly when and where moisture accumulates through condensation and other moisture introduction processes.

Both industry standards and state regulatory agencies require placement of steel wear plates directly under each access port to prevent this corrosion accelerating process on the bottom of each tank. However, corrosion has also been found adjacent to or under these corrosion wear plates due to the development of corrosion inducing microbacteria and other galvanic corrosion inducing processes. Corrosion also occurs elsewhere in the tank such as adjacent seams or at other points therein.

There is a need to further protect against mechanical damage and corrosion to fuel or other types of liquid storage tanks at the location of wear plates and elsewhere throughout the tanks. There is also a need to improve the corrosion resistance of wear plates themselves.

SUMMARY OF THE INVENTION

In accordance with the present invention, there is provided a novel wear plate with galvanic protection that reduces or eliminates mechanical damage and corrosion to the bottom, sides or walls of steel fuel storage tanks, other storage tanks, and to wear plates themselves. The improved wear plate reduces or eliminates the current style of steel wear plates.

The present invention is directed to the development of a combination galvanic anode and wear plate. The placement of galvanic anodes in the bottom of storage tanks can reduce or eliminate the corrosion process in the tanks. By combining the function of the steel wear plate, which also functions as the core strap for the anode casting, and a galvanic anode, a synergistic effect is achieved at a substantially reduced cost over two separately installed elements.

The present invention contemplates the use of any suitable galvanic anode material that will function in the storage tank environment. In the case of fuel storage tanks, the preferred galvanic anode material is zinc. Zinc is preferred because it is non sparking and, therefore, approved for use in confined spaces containing flammable substances.

The present invention further contemplates the use of integrated wear or striker plates and anodes for use anywhere inside liquid storage tanks in order to reduce or eliminate corrosion damage to the tanks.

An advantage of the present invention is that the life of the storage tanks will be increased due to a reduction in corrosion.

Another advantage of the present invention is the reduction in corrosion and mechanical damage to storage tanks which, in turn, reduces risk of leaks and exposure of the storage tank contents to the surrounding environment.

Another advantage is found in the increased life of the wear plate over conventional steel wear plates.

Yet another advantage of the present invention is found in the cost savings achieved in developing a single combined anode and wear plate unit over the separate installation of the two elements.

Still other advantages and benefits of the invention will become apparent to those skilled in the art upon reading and understanding of the following detailed description.

BRIEF DESCRIPTION OF THE DRAWINGS

The invention may take physical form in certain parts and arrangements of parts, a preferred embodiment which will be described in detail in the specification and illustrated in the accompanying drawings which form a part hereof.

DESCRIPTION OF THE PREFERRED EMBODIMENT

Figure 1:
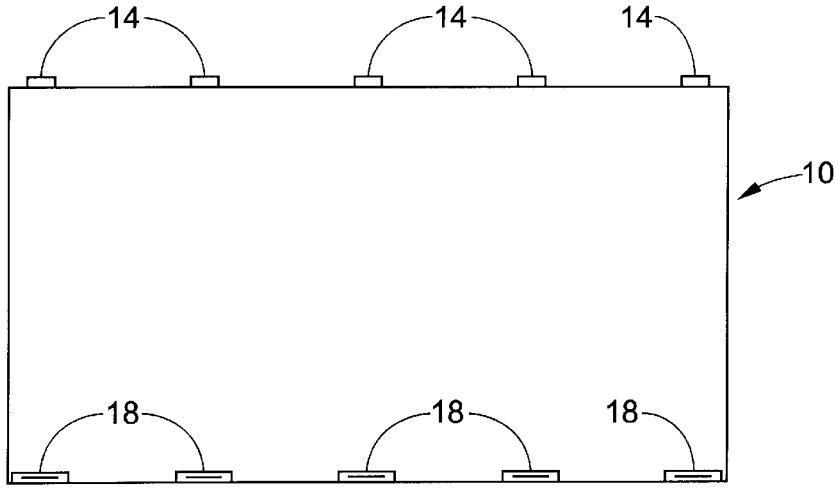
FIG. 1 is schematic representation of a side view of a fuel storage tank.

Referring now to the drawings wherein the showings are for purposes of illustrating the preferred embodiment of the invention only and not for purposes of limiting same, the figures show a steel wear plate and galvanic anode combination situated in a fuel tank environment.

FIG. 1 is a side view of a fuel storage tank 10. A plurality of access ports 14 are shown across the top of the tank. Combination or integrated galvanic anodes and wear plates 18 are shown directly opposite or under each access port. This is simply a typical arrangement of the anode/striker plate placement within the tank. The integrated striker plate and anode could likewise be placed anywhere inside the tank, such as for example at a lapped seam, or anywhere that corrosion protection is desired or needed. The placement of galvanic anodes in the bottom of storage tanks can reduce or eliminate the corrosion process.

The present invention contemplates the use of any suitable galvanic anode material that will function in the storage tank environment.

Figure 2:
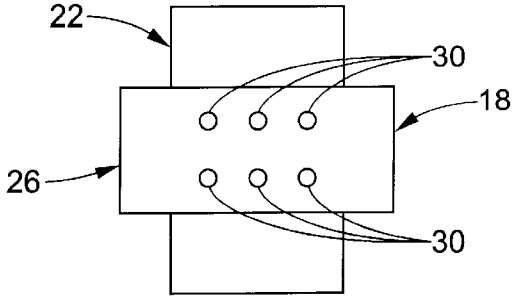
FIG. 2 schematically depicts a combination galvanic anode and wear plate.
Figure 3:
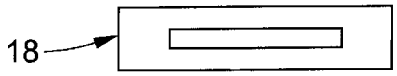
FIG. 3 shows a side view of the combination galvanic anode and wear plate of FIG. 2.

FIGS. 2 and 3 depict a combination galvanic anode and wear plate 18. The combination comprises a steel wear plate portion 22, and a galvanic anode portion 26 integrated with or affixed to the steel wear plate. Although any suitable galvanic anode material can be used, zinc is preferred because it is non sparking and therefore approved for use in confined spaces containing flammable substances such as fuel and other substances. Alternative galvanic anode materials include magnesium and aluminum and others. Zinc, magnesium and aluminum are preferred anode materials for use in steel tanks. The anode can be cast around or on the galvanized steel wear plate, or the anode could be otherwise fastened or adhered to the plate. A plurality of perforations 30 are defined by the anode in the Figures. These apply to the cast example. In the case of anodes fastened by studs or adhered by other means, the perforations may not be present.

The anode can be larger or smaller than the wear plate. It can be cast around the plate, or the plate can be layered on the anode. The plate can be exposed or not exposed by the anode. In a preferred embodiment, as discussed below, the steel plate is replaced by a steel core rod. In such a situation, the anodic material itself becomes the striker or wear plate.

Figure 4:
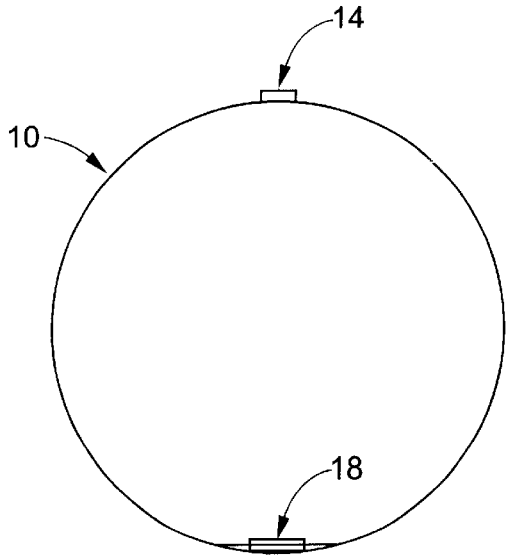
FIG. 4 is an end view of a storage tank with a combination galvanic anode and wear plate situated opposite an access port.

FIG. 4 is an end view of the tank with the anode and wear plate combination 18 welded in place under an access port. The combination can be welded directly under each tank access port by the tank fabricator, or at ends or seams of the tank or anywhere in the tank where corrosion is foreseeable. The tanks can be designed to hold any type of liquid, including fuel, water, chemicals, petroleum based products, and so on. The water or condensation serves as the electrolyte for the corrosion reduction process to occur.

Figure 5A:
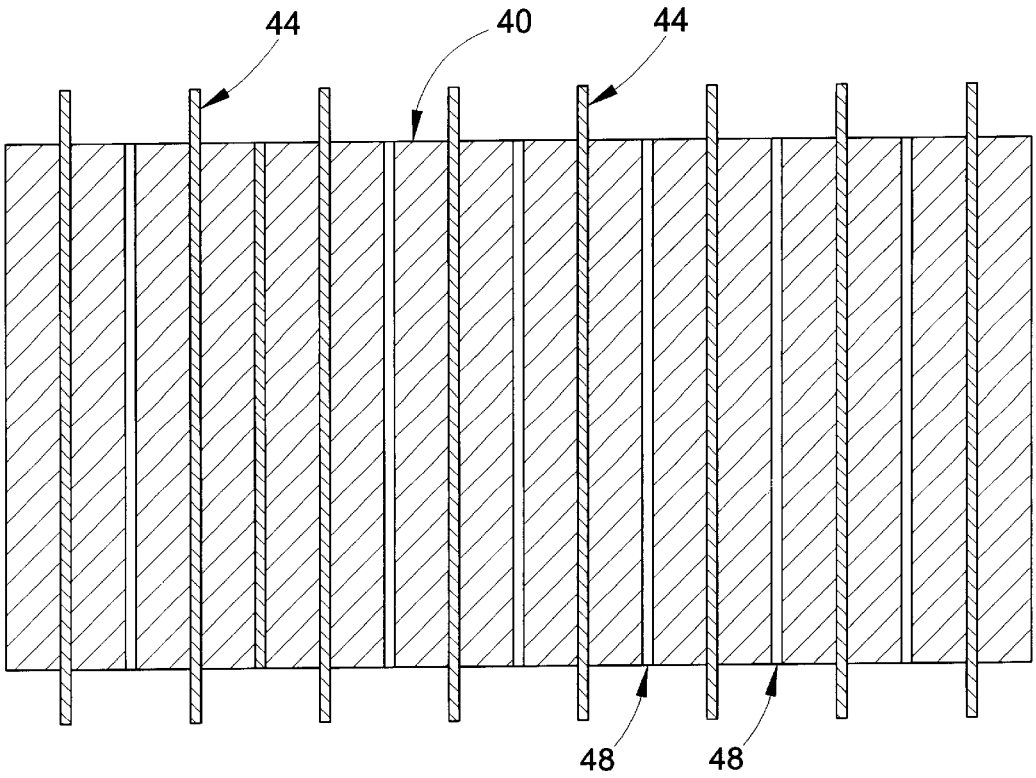
FIGS. 5A and 5B provide a schematic representation of an integral cast striker plate and anode.
Figure 5B:
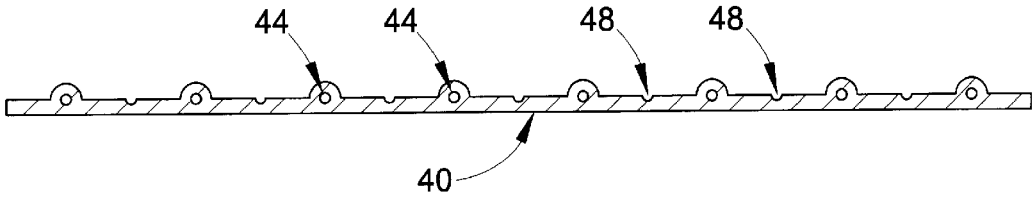

The striker unit of FIGS. 5A and 5B is integrally cast as one large plate, which provides for a less expensive production cost over separate castings. The galvanic material makes up the striker portion of the plate 40. A galvanized steel core rod 44 is provided within the plate. The plate can be split apart to create any width anode as long as it preferably includes at least one galvanized steel core wire (rod or strap) 44. Preferably, the plate includes a seam or detent 48 which makes it easier to separate the sheet into different pieces, although its presence is not absolutely necessary. The plurality of seams or detents shown in FIGS. 5A and 5B also make it easier to bend the anode to conform to cylindrically curved surface of the tank bottom.

The galvanic wear plate of the present invention can distribute a current up to five to ten feet away. As a result, it is possible that only four or five plates are required for a ten-thousand gallon tank.

A typical size of striker plate anode might be in a range of 8"×8" to 8"×12" to 12"×12", or larger or smaller. Additional smaller sizes could be used in between striker plate locations for protection on the bottom centerline of a tank or over lapped seams on the bottom of a tank. For example, the size in this case might be 3"×12", or greater or smaller. The rod space could be changed when cast to allow 2" wide strips or whatever spacing might be deemed suitable.

The invention has been described with reference to the preferred embodiment. Obviously modifications and alterations will occur to others upon a reading and understanding of this specification. It is intended to included all such modifications and alterations.

Having thus described the preferred embodiment, the invention is now claimed to be:

1. An improved striker/wear plate for tanks, consisting essentially of:

a substantially flat and unitary sacrificial galvanic anode sheet and striker plate combination; and a galvanized steel core rod in contact therewith.

2. The striker/wear plate of claim 1 wherein the galvanic anode sheet is comprised of zinc.

3. The striker/wear plate of claim 1 wherein he galvanic anode sheet is comprised of magnesium.

4. The striker/wear plate of claim 1 wherein the galvanic anode sheet is comprised of aluminum.

5. The striker/wear plate of claim 1 including a plurality of steel core rods in spaced parallel relation to one another.

6. A storage tank for fluids, comprising:

a striker plate comprised of a sacrificial galvanic anode and a steel core, the striker plate situated opposite an access opening used for measuring depth of fluid in the tank.

7. The storage tank of claim 6 wherein the galvanic anode is comprised of zinc.

8. The storage tank of claim 6 wherein the galvanic anode is comprised of magnesium.

9. The storage tank of claim 6 wherein the galvanic anode is comprised of aluminum.

10. A method of reducing corrosion in a storage tank, comprising the steps of:

forming a unitary sacrificial galvanic anode sheet and striker plate combination by integrating a steel core with a galvanic anode material;

placing the unitary sacrificial galvanic anode sheet and striker plate combination in a tank opposite an access opening used for measuring depth of fluid in the storage tank sacrificing the galvanic anode sheet and striker plate combination to prevent corrosion in the tank adjacent the striker plate.

11. An improved striker plate for storage tanks, comprising a sacrificial galvanic anode sheet striker plate including a plurality of seams or detents which enable the bending or separating of the sheet into multiple sections for conforming spacing within the tank;

and a galvanized steel core rod in contact therewith.

12. The striker/wear plate of claim 11 including a plurality of steel core rods in spaced parallel relation to one another.

* * * * *